US010058744B1

(12) United States Patent
Yost

(10) Patent No.: US 10,058,744 B1
(45) Date of Patent: Aug. 28, 2018

(54) GOLF EQUIPMENT WASHING MECHANISM FOR USE ON CONVENTIONAL GOLF BALL WASHERS

(71) Applicant: Vincent G. Yost, Harleysville, PA (US)

(72) Inventor: Vincent G. Yost, Harleysville, PA (US)

( * ) Notice: Subject to any disclaimer, the term of this patent is extended or adjusted under 35 U.S.C. 154(b) by 0 days.

(21) Appl. No.: 15/460,765

(22) Filed: Mar. 16, 2017

Related U.S. Application Data

(63) Continuation-in-part of application No. 15/397,369, filed on Jan. 3, 2017.

(60) Provisional application No. 62/328,794, filed on Apr. 28, 2016.

(51) Int. Cl.

| | |
|---|---|
| ***A63B 47/04*** | (2006.01) |
| ***B08B 3/00*** | (2006.01) |
| ***B08B 3/10*** | (2006.01) |
| ***A63B 57/60*** | (2015.01) |
| ***B05B 11/00*** | (2006.01) |

(52) U.S. Cl.
CPC ..... *A63B 47/04* (2013.01); *A63B 57/60* (2015.10); *B05B 11/3001* (2013.01); *B05B 11/3045* (2013.01); *B08B 3/003* (2013.01); *B08B 3/10* (2013.01); *A63B 2047/043* (2013.01); *A63B 2057/605* (2015.10)

(58) Field of Classification Search
CPC ..... A63B 47/04; A63B 57/60; B02B 11/3001; B02B 11/3045; B02B 11/3047; B02B 9/043; B08B 3/003; B08B 3/10; F04B 23/028; F04B 9/14
See application file for complete search history.

(56) References Cited

U.S. PATENT DOCUMENTS

| | | | | |
|---|---|---|---|---|
| RE6,396 | E * | 4/1875 | Gray | 222/111 |
| 1,517,805 | A * | 12/1924 | Spaeth | B67D 7/60 222/109 |
| 2,344,005 | A | 3/1944 | Sundholm | |
| 2,499,061 | A * | 2/1950 | Gray | F16N 5/00 222/109 |
| 2,608,705 | A | 9/1952 | Duff | |

(Continued)

OTHER PUBLICATIONS

Putting Green—Golf Ball Washer—Deluxe Ensemble—Par Aide Blue, https://www.amazon.com/Putting-Green-Washer-Deluxe-Ensemble/dp/B0025QRF0U?SubscriptionId=AKIAIKOHFALUJCKC3KXQ&tag=bdyahoo-desk-20&linkCode=xm2&camp=2025&creative=165953&creativeASIN=B0025QRF0U&m=AN2GJJAXKHGZY, Oct. 7, 2016.

(Continued)

*Primary Examiner* — David Angwin
*Assistant Examiner* — Bob Zadeh
(74) *Attorney, Agent, or Firm* — Caesar Rivise, PC

(57) ABSTRACT

A device, method and kit for replacing a conventional golf ball washing assembly that uses a crank lever, as well as its shaft (which fits into a base on the ground) to easily convert it to an eco-friendly item washing device is provided. The invention involves a hollow support tube and an associated head having a pump assembly releasably secured thereon. The entire conventional washer is removed, except for the base, and one end of the support tube is inserted into the base. The pump assembly is removed and a cleaning solution is poured through the head and into the support tube. The pump assembly is re-attached. A head nest receives a "dirty" golf ball therein. When placed in the nest, pump activation dispenses the cleaning solution directly onto the ball or other golf item, in a limited delivery of cleaning solution to the dirty item to reduce waste.

19 Claims, 13 Drawing Sheets

(56) References Cited

U.S. PATENT DOCUMENTS

| | | | | |
|---|---|---|---|---|
| 2,807,037 | A | 9/1957 | Garske | |
| 3,078,471 | A | 2/1963 | Knibb | |
| 3,304,659 | A | 2/1967 | Eichhorn | |
| 4,210,974 | A | 7/1980 | Stoltzman | |
| 4,350,457 | A | 9/1982 | Carnahan | |
| 4,701,968 | A | 10/1987 | Stoltzman | |
| 5,056,946 | A | 10/1991 | Larkin | |
| 5,184,751 | A * | 2/1993 | Middleton | B67D 7/0288 141/334 |
| 5,269,615 | A | 12/1993 | Lewis, Jr. | |
| 5,350,087 | A * | 9/1994 | Frazier | A47K 5/1205 222/153.09 |
| 5,806,122 | A | 9/1998 | Bogle et al. | |
| 6,032,312 | A | 3/2000 | Hope et al. | |
| 6,216,920 | B1 * | 4/2001 | Baggett | B05B 11/0005 222/192 |
| 6,269,509 | B1 | 8/2001 | Mays | |
| 6,282,741 | B1 | 9/2001 | Manning | |
| 8,795,438 | B2 | 8/2014 | Rubin et al. | |
| 2001/0035429 | A1 * | 11/2001 | Colquhoun | A47K 5/12 222/93 |
| 2002/0079380 | A1 * | 6/2002 | Presson | B05B 11/0005 239/289 |
| 2003/0000553 | A1 | 1/2003 | Murray | |
| 2008/0135581 | A1 | 6/2008 | Kennedy et al. | |
| 2009/0020552 | A1 * | 1/2009 | van der Heijden | B05B 7/0037 222/190 |
| 2010/0043850 | A1 | 2/2010 | Kiener | |
| 2011/0272432 | A1 * | 11/2011 | Baughman | B05B 7/0037 222/136 |
| 2014/0101875 | A1 | 4/2014 | Fengel | |

OTHER PUBLICATIONS

Perfect Solutions Motorized Golf Ball Cleaner, https://www.amazon.com/Perfect-Solutions-Motorized-Golf-Cleaner/dp/B000C7LQPO, Sep. 15, 2016.

Aerospray Stethoscope Sterilizer, https://www.changemakers.com/innovations4health/entries/aerospray-stethoscope-sterilizer, Sep. 15, 2016.

Rieke Dispensing Unveils New Foamer Dispensers, http://www.packagingnews.co.uk/news/rieke-dispensing-unveils-new-foamer-dispensers-13-09-2012, Sep. 13, 2012.

GOJO 5261-02 FMX-20 Luxury 2000 mL Cranberry Foaming Hand Soap, http://www.webstaurantstore.com/gojo-5261-02-fmx-20-luxury-2000-ml-cranberry-foaming-hand-soap/999G526102.html?utm_source=Google&utm_medium=cpc&utm_campaign=GoogleShopping&gclid=CN3vyq7Hs9ICFZuCswodF7sEgA, Feb. 28, 2017.

Classic Ball Washer, http://www.diseymagolf.com/lavabolas-classic.html?_store=en&_from_store=es, Mar. 15, 2017.

* cited by examiner

GOLF EQUIPMENT WASHING MECHANISM FOR USE ON CONVENTIONAL GOLF BALL WASHERS

CROSS-REFERENCE TO RELATED APPLICATIONS

This continuation-in-part application claims the benefit under 35 U.S.C. § 120 of application Ser. No. 15/397,369 filed on Jan. 3, 2017 entitled GOLF EQUIPMENT WASHING MECHANISM FOR USE ON CONVENTIONAL GOLF BALL WASHERS, which claims the benefit under 35 U.S.C. § 119(e) of Application Ser. No. 62/328,794 filed on Apr. 28, 2016 entitled GOLF BALL WASHING MECHANISM FOR USE ON CONVENTIONAL GOLF BALL WASHING MACHINES and all of whose entire disclosures are incorporated by reference herein.

BACKGROUND OF THE INVENTION

The present invention relates to golf ball washers and more particularly to a kit for replacing the head of existing golf ball washers with a more sanitary and environmentally-friendly cleaning mechanism.

As shown most clearly in FIG. 1, popular current golf ball washers 1 comprise a top portion 2, including an associated heavy-brush assembly 3 (FIG. 2A), which are respectively positioned on top and inside a "head" 4 which typically contains water (not shown). See, for example, U.S. Pat. No. 2,807,037 (Garske), which is also incorporated by reference herein. To wash a golf ball (not shown), a gripping knob 3A (at the upper end of the heavy brush assembly 3) is pulled upward, the dirty golf ball inserted in the brush assembly 3, and then the brush assembly 3 with the golf ball are "aggressively" reciprocated up and down to "clean" the dirty golf ball through repeated reciprocations by the golfer, until the golf ball is deemed clean. The golfer can then dry off the ball using the towels 5 hanging on either side of the post 6 supported on a base 7.

However, this design has several inherent flaws: (1) the water gets progressively more dirty and filthy with each use; (2) sunlight, warmth and water cause bacteria growth which often causes the water to become increasingly foul-smelling and germ-concentrated; (3) this bacteria often lingers on a golfer's hands which can be transferred to food or other people, putting everyone at risk for illness; (4) the many parts often become rusty, break and need replacing; (5) because the water becomes progressively more dirty and foul-smelling with every use, loss of water due to splashing, and often mechanical break downs, these conventional ball washers need constant attention for refilling, cleaning and mechanical repair; and (5) the only golf-related item that can be cleaned using this design is a golf ball; no other golf related equipment can be cleaned with a conventional cleaning mechanism (other than with the towels 5).

FIG. 7 depicts another style of conventional golf ball washing machines that uses a crank mechanism rather than a heavy brush assembly that is reciprocated into a washing head (see FIG. 1). Referred to as "Classic Ball Washer" (manufactured by Standard Golf Company of Cedar Falls, Iowa) this golf ball washer 1A comprises a head 1B having a pivoting lid 1C and a crank handle 1D. A towel hook 1E is also provided for holding a towel (not shown) to dry the cleaned ball. The head 1B is positioned on a shaft 6A having a bottom end that is positioned within a base ring 7B of a base 7A. To use the washer 1A, the user lifts open the lid 1C, places a dirty golf ball into the head 1B which is filled with water or soap, closes the lid 1C and then cranks the handle 1D once which forces the "dirty" golf ball through the water and returns it to the top of the head 1A where the user then lifts open the lid 1C to retrieve his/her washed ball. However, this design suffers from the same inherent flaws discussed previously with regard to FIG. 1.

Thus, there remains a need for a golf ball cleaning mechanism that can be used with these conventional golf ball washers but which do not suffer from the above-identified problems and wherein this cleaning mechanism can be easily installed for a variety of differently-shaped heads of these conventional golf ball washers or for replacing the entire ball washer and shaft of this style of conventional golf ball washers.

All references cited herein are incorporated herein by reference in their entireties.

BRIEF SUMMARY OF THE INVENTION

A device is disclosed for converting a conventional golf ball washer, having a lid with an internal cleaning assembly activated by a crank lever and all of which of which are supported on a shaft inserted into a base that rests on the ground, into a more environmentally-friendly, multi-golf item cleaning device. The device comprises: a head having a removable pump assembly having an intake line and a spout; an elongated hollow support tube having a closed bottom and open top, wherein the open top is coupled to the head and wherein the intake line passes through the head and through the open top and wherein the closed bottom is inserted within the base, and wherein the elongated support tube is adapted to receive a cleaning solution (e.g., a foaming soap solution, etc.) therein; and wherein the pump assembly delivers a predetermined amount of the cleaning solution to an item positioned under the spout when the pump assembly is activated.

A method is disclosed for converting a conventional golf ball washer, having a lid with an internal cleaning assembly activated by a crank lever and all of which are supported on a shaft inserted into a base that rests on the ground, into a more environmentally-friendly, multi-golf item cleaning device, said method comprises: removing the conventional golf ball washer and shaft from the base; inserting a closed end of an elongated hollow support tube into the base; coupling a head onto an open end of the elongated hollow support, and wherein the head includes an opening aligned with the open end and adapted for receiving a pump assembly therethrough; pouring a cleaning solution (e.g., a foaming soap solution, etc.) through the opening and into the elongated hollow support tube; and inserting the pump assembly having an intake line through the opening such that the intake line is positioned within the cleaning solution and a spout of the pump assembly is available for dispensing the cleaning solution.

A kit is disclosed for converting a conventional golf ball washer, having a lid with an internal cleaning assembly activated by a crank lever and all of which of which are supported on a shaft inserted into a base that rests on the ground, into a more environmentally-friendly, multi-golf item cleaning device. The kit comprises: a head adapted for coupling with an elongated hollow support tube on a first end of the support tube and wherein a second end of the support tube is adapted for insertion into the base for replacing the conventional golf ball washer and shaft, and wherein the head comprises a pump assembly having an intake line that is adapted for passing through the head and into the elongated hollow support tube; and a container of cleaning solution (e.g., a foaming soap solution, etc.), wherein the cleaning solution is poured through an opening in the head and into an opening in the first end before the pump assembly is installed into the head.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1:
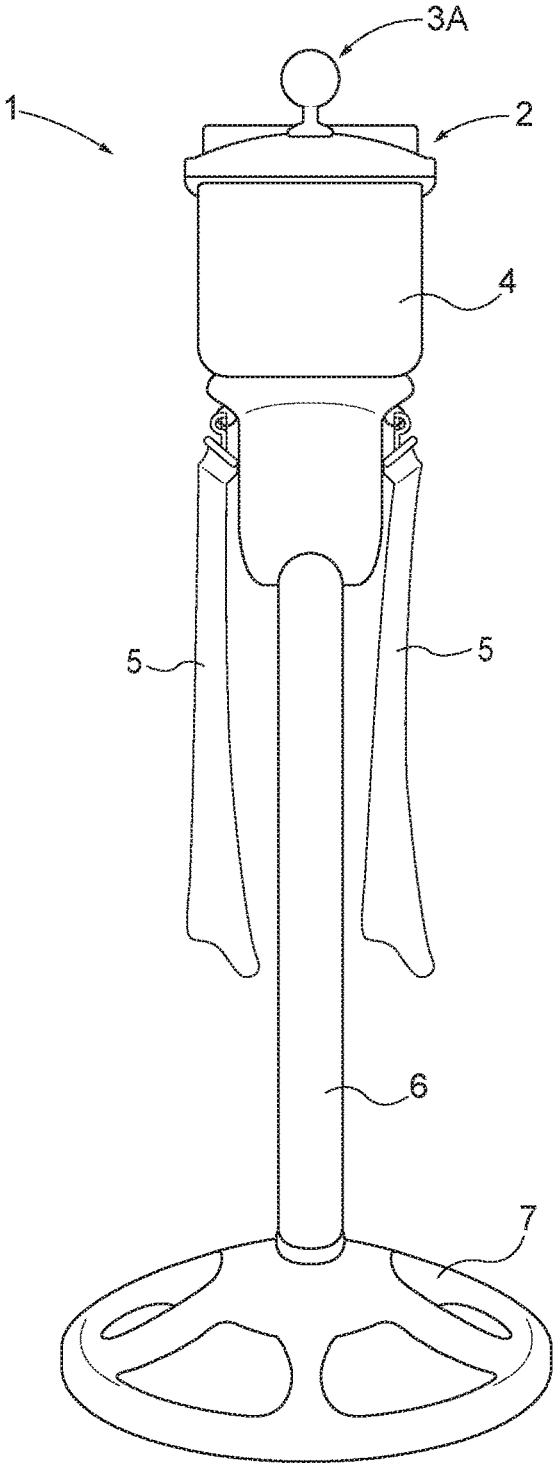
FIG. 1 (Prior Art)
FIG. 1 is a side view of an exemplary prior art conventional golf ball washer.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 2A:
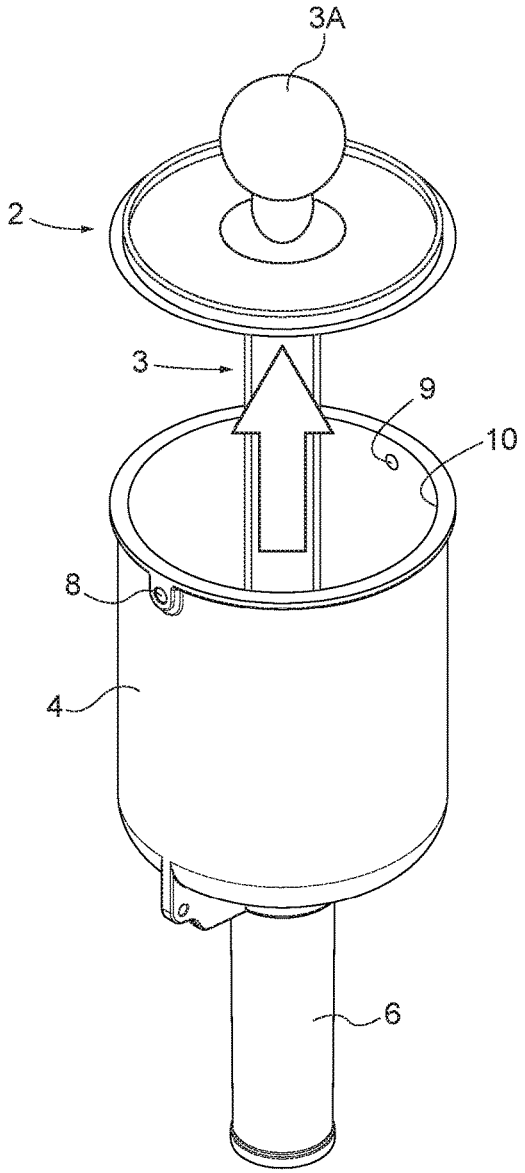
FIG. 2A (Prior Art)
FIG. 2A is a partial isometric view of the conventional golf ball washer of FIG. 1 showing the top and heavy brush assembly being removed.
Figure 2B:
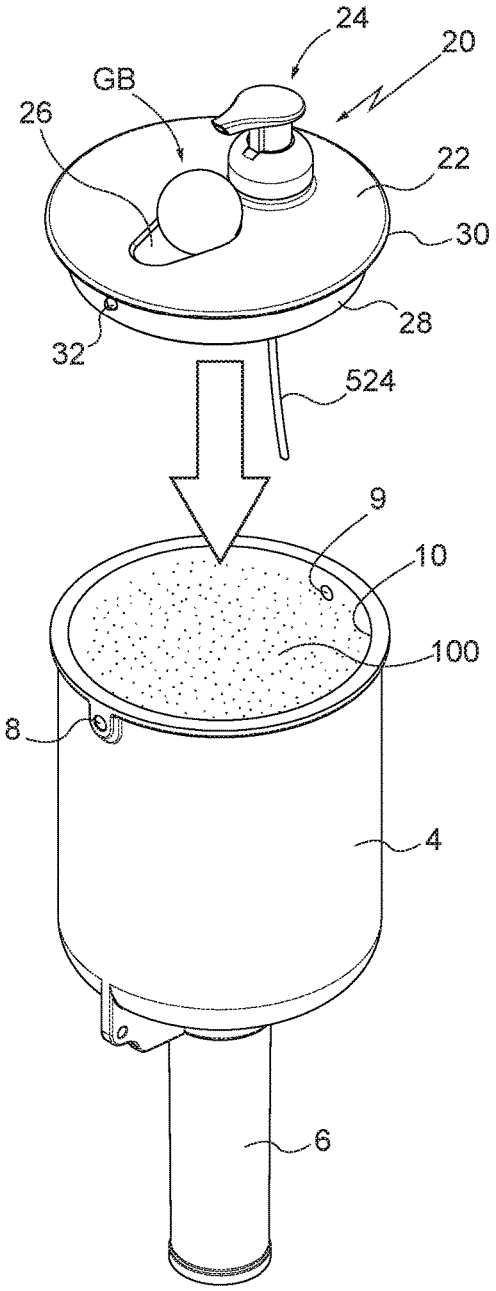
FIG. 2B is an isometric view showing the present invention replacing the top and heavy brush assembly on the same "head" of the conventional golf ball washer but after the contaminated water in the head has been replaced with a cleaning solution.
Figure 3:
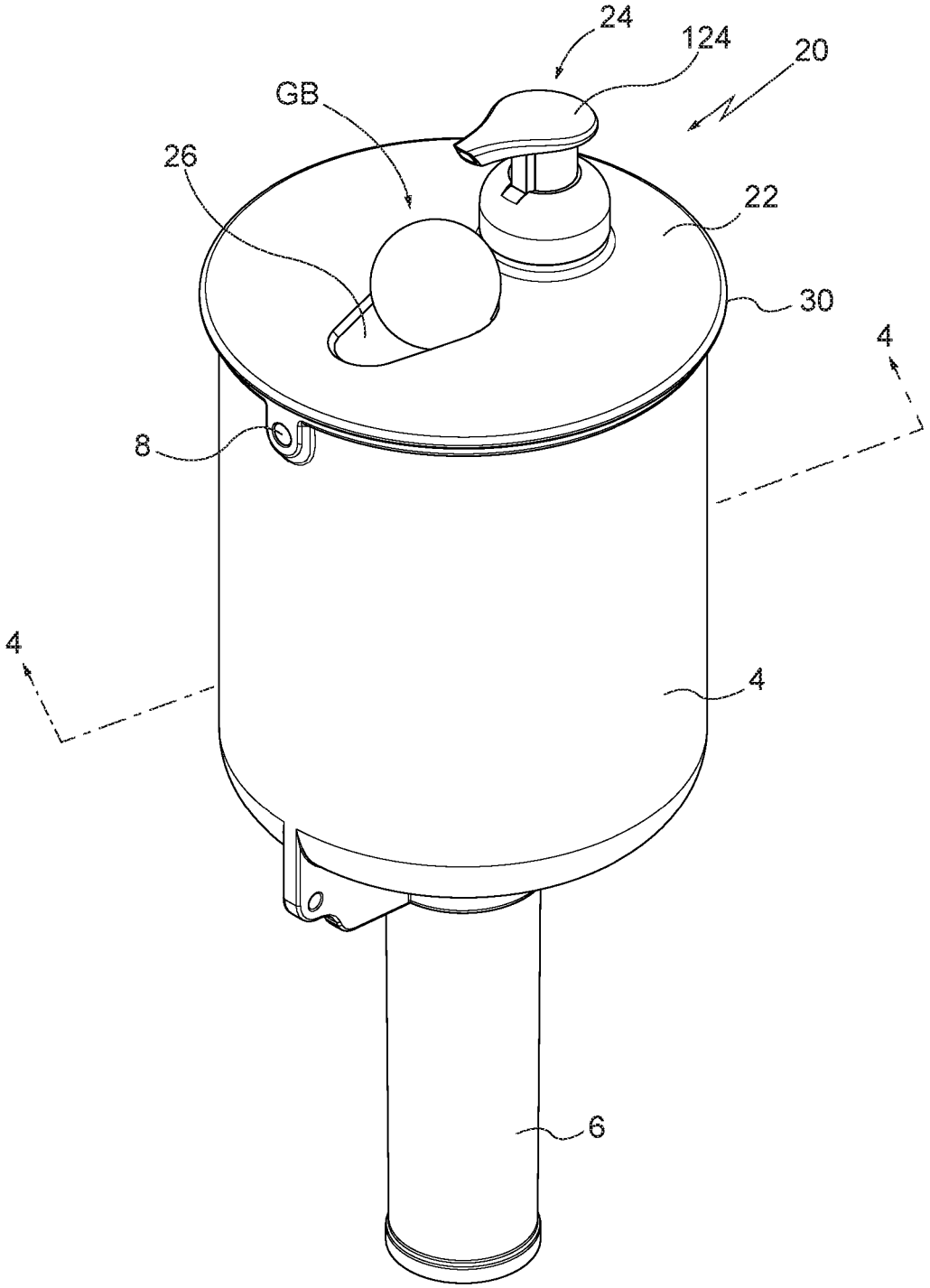
FIG. 3 is an isometric view of the present invention installed on the head of the conventional golf ball washer.
Figure 4:
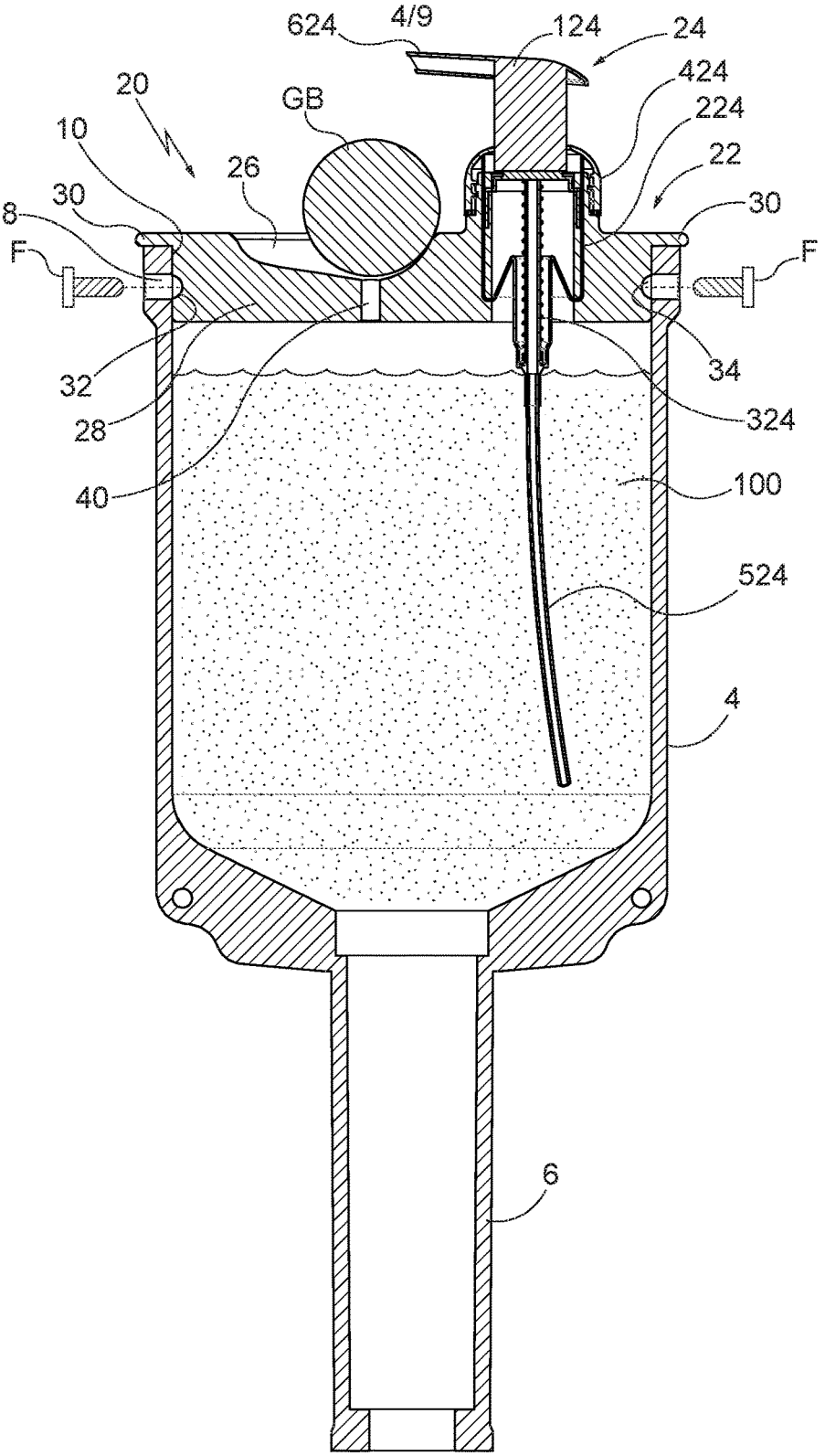
FIG. 4 is a cross-sectional view of the present invention installed on the head of the conventional golf ball washer taking along line 4-4 of FIG. 3.

As shown in FIG. 3, the top portion 2 and associated heavy-brush assembly 3 of a "round" head 4 have been removed and replaced with the present invention 20. The present invention 20 comprises a top 22 having a pump dispenser 24 as well as a golf ball nest 26 for receiving a golf ball GB therein. The top 22 may comprise an aluminum material, although other materials can be used and the present invention 20 is not limited to that material. As can be seen in FIGS. 2B and 4-5A, the top 22 further comprises a circular insert 28 that fits snugly within the circular opening 10 of the head 4 while the outer edge 30 of the top 22 forms a "shoulder" that rests on top of the head 4 opening (FIG. 4). To releasably secure the top 22 to the head 4, a pair of apertures 32 and 34 align with respective apertures 8 and 9 in the head 4. A fastener F (e.g., a set screw, a bolt, a pin, etc., see FIG. 4) can then be inserted in each pair of aligned apertures and hand-tightened to releasably secure the top 22 within the opening to the head 4.

As can be appreciated most clearly from FIG. 4, the outer edge 30 forms a "low profile" top 22 such that the top 22 does not project significantly above the head 4 when installed thereon.

The pump dispenser 24 (e.g., F6 Series, 40 mm, Foamer from Rieke Packaging, part #AAF6S08D) comprises a displaceable pump head 124, pump body 224, spring 324, threaded collar 424, intake tube 524, and spout 624. All of these components are well-known in the industry and, as such, are not discussed in any further detail. The threaded collar 424 releasably engages corresponding threads 36 (FIG. 5A) on the pump opening 38 in the top 22. The spout 624 is positioned over the golf ball nest 26 for dispensing the cleaning solution over the dirty golf ball GB placed in the nest 26. It should be noted that, as with most hand/finger activated pumps, the pump head 124 can be rotated 360°, although it is typically positioned over the golf ball nest 26. A small drain hole 40 is provided in the golf ball nest 26 at its lowest point (see FIG. 4) to prevent rain water, melting snow, etc., or excess foaming soap from collecting in the golf ball nest 26. The excess foaming soap and rain water, or other accumulated water have no measurable impact on the cleaning solution 100 contained within the head 4.

Figure 6A:
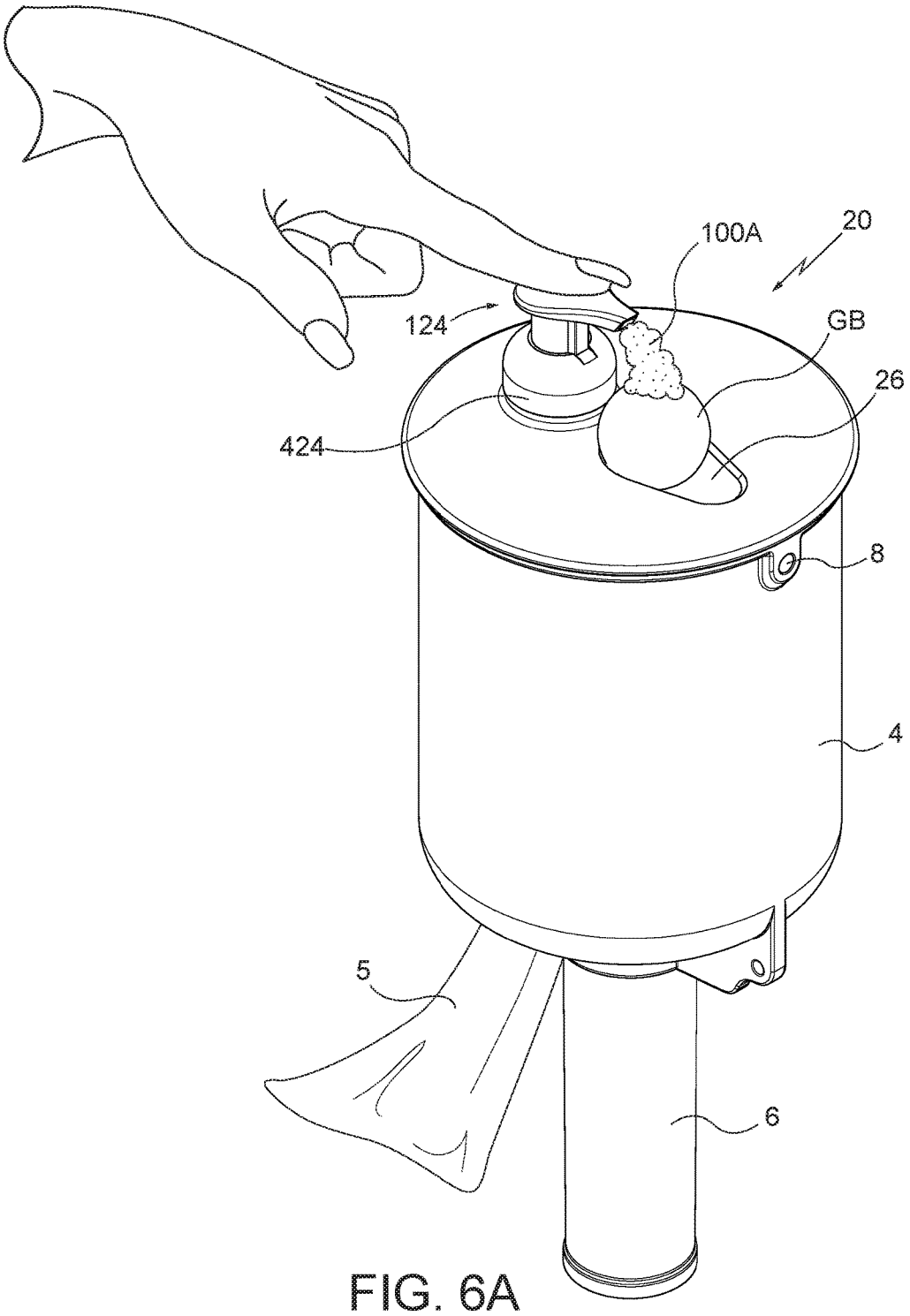
FIGS. 6A-6B depict the process of how a "dirty" golf ball is cleaned using the present invention.
Figure 6B:
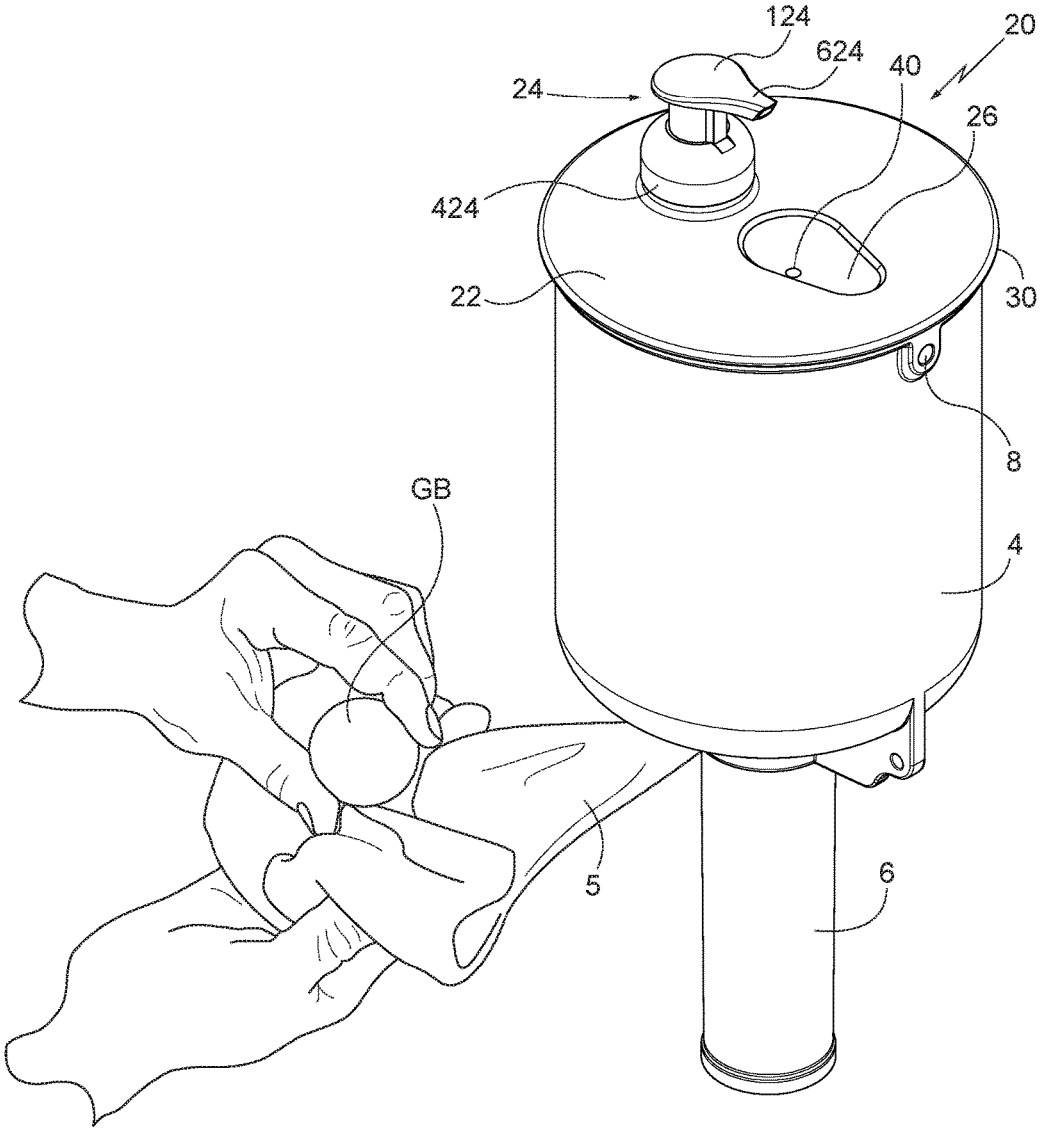
Figure 6C:
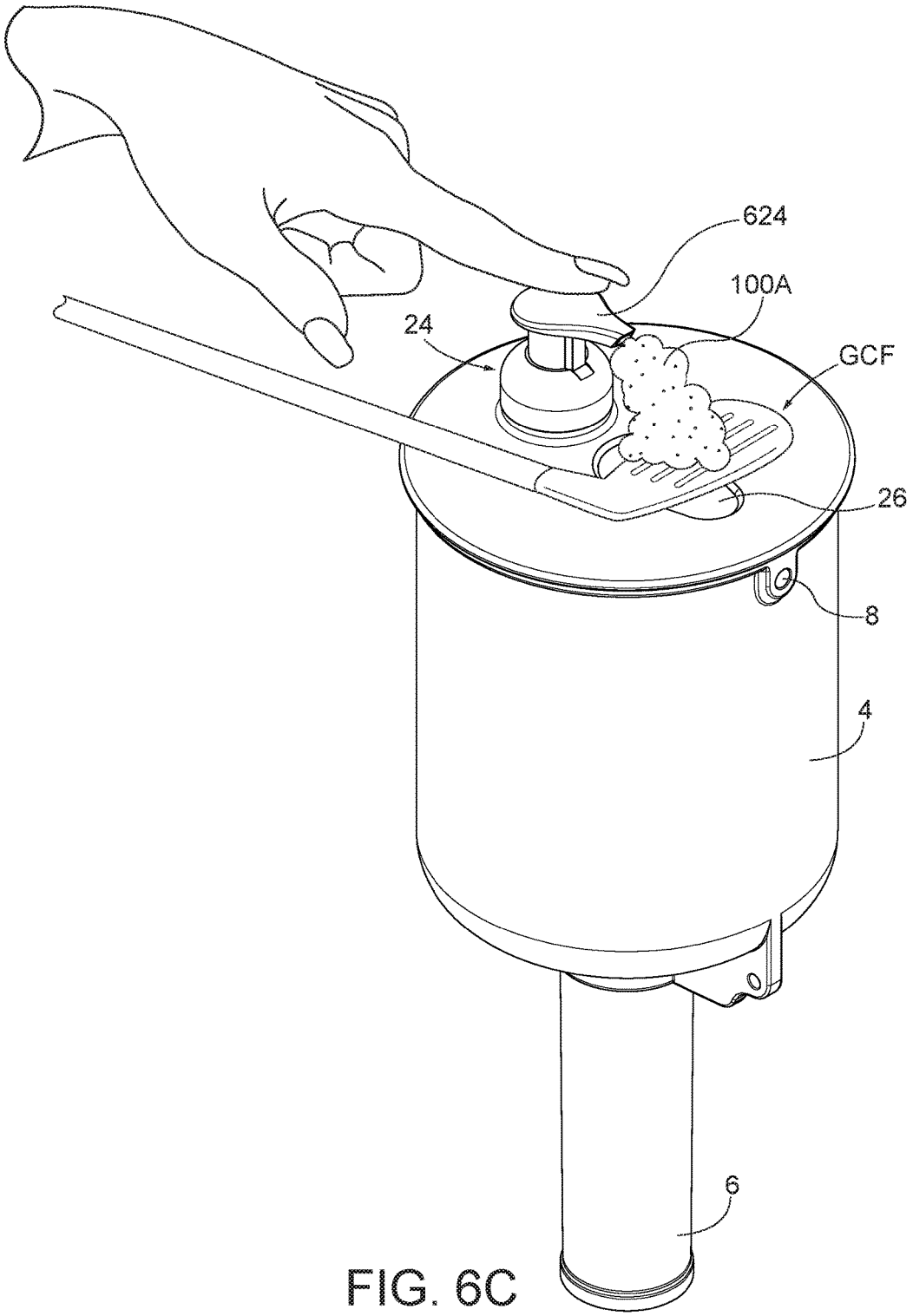
FIGS. 6C-6D depict the process of how a "dirty" golf equipment (e.g., a golf club face) is also cleaned using the present invention.

The cleaning solution 100 (e.g., a foaming soap, such as those manufactured by Dial, GOJO Industries, Inc., Kutol Products Company, etc.) is poured into the head 4 before the top 22 is installed on the head 4. When the pump head 124 is depressed by the user, air is injected into the cleaning solution 100, a portion of which is drawn up through the intake tube 524 and a foaming soap solution 100A is dispensed out of the spout 624 and onto the dirty golf ball GB, as shown in FIG. 6A. This is important in that the cleaning solution 100 is removed from the head 4 and applied to the golf ball GB placed in the nest 26. As such, the cleaning solution (i.e., the foaming soap solution 100A) that contacts the dirty golf ball GB becomes "contaminated" but is never returned to the inside of the head 4, thereby preserving the sterility of the cleaning solution 100, unlike the conventional golf ball washer 1. Thus, once the user depresses the pump head 124 (e.g., using his/her finger, his/her palm, etc.) and dispenses the foaming soap solution 100A on the dirty golf ball GB, the golf ball GB becomes covered with the foaming soap solution 100A. The user then removes the ball GB from the cavity 26 and wipes the foaming soap solution 100A from the washed golf ball using the towel(s) 5, as shown in FIG. 6B. This towel-drying action moves the foaming soap around the golf ball GB, thus cleaning and polishing the ball GB. The finger (or otherwise hand)-operated air injection pump 24 infuses air into cleaning solution 100 to produce and dispense a rich, cleaning and polishing foam 100A directly onto the dirty golf ball GB, or dirty golf equipment (e.g., a golf club head, etc., see FIG. 6C).

Figure 5A:
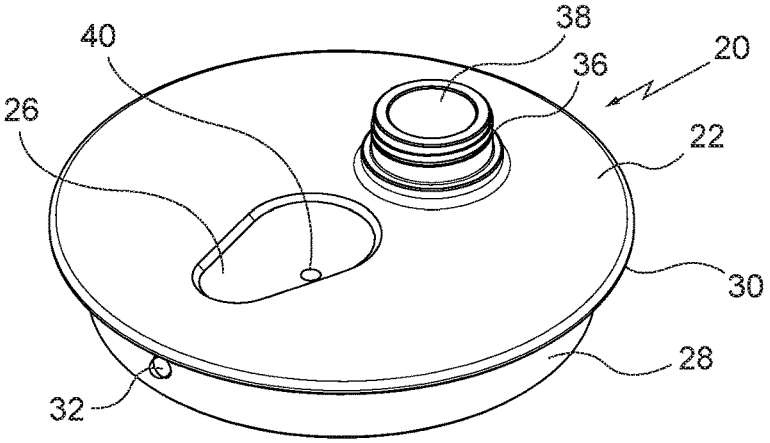
FIG. 5A depicts an isometric view of the top of the present invention, showing a "circular top" for use on a "circular" head of a conventional golf ball washer and without the pump mechanism installed.
Figure 5B:
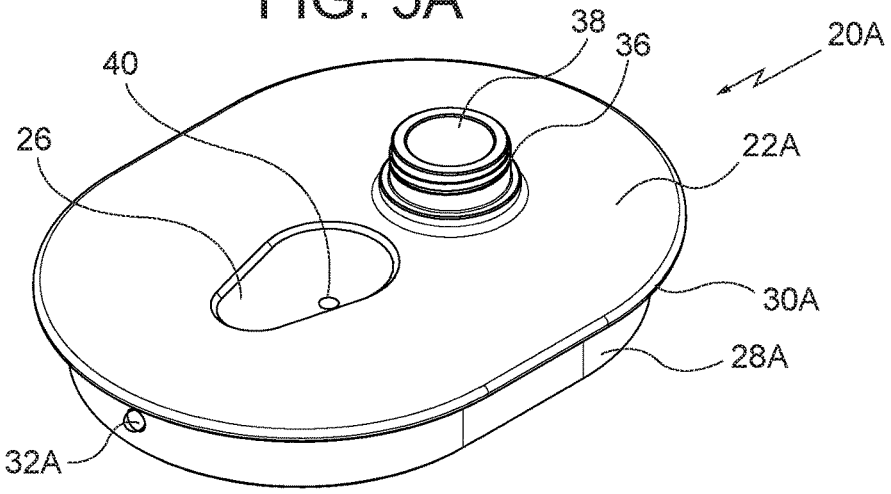
FIG. 5B depicts an isometric view of the top of a second embodiment of the present invention, showing an "oval top" for use on an "oval" head of a conventional golf ball washer and without the pump mechanism installed.
Figure 5C:
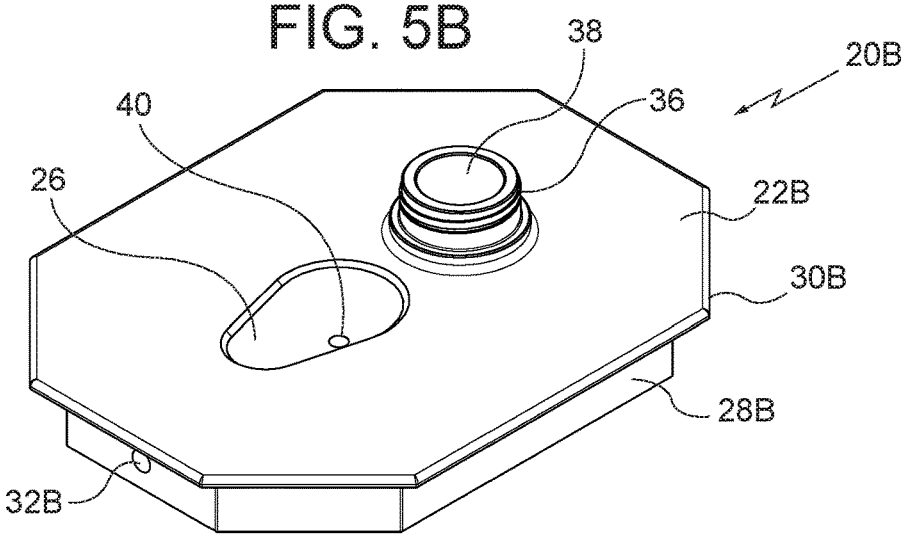
FIG. 5C depicts an isometric view of the top of a third embodiment of the present invention, showing an "octagonal top" for use on an "octagonal" head of a conventional golf ball washer and without the pump mechanism installed.

The present invention 20 discussed so far comprises a replacement top 22 for a "round" head 4. There are other conventional golf ball washers 1 that utilize oval-shaped heads and octagonal-shaped heads. In order to replace the tops of those styles of conventional golf ball washers 1 with the present invention, FIG. 5B depicts a second embodiment 20A that comprises an oval-shaped top 22A/insert 28A and FIG. 5C depicts a third embodiment 20B that comprises an octagonal-shaped top 22B/insert 28B. As such, reference numbers ending in "A" in FIG. 5B and reference number ending in "B" in FIG. 5C correspond to their counterpart in the first embodiment 20 discussed previously. Thus, for example, to make a snug fit in an oval-shaped head, the second embodiment 20A comprises an oval-shaped insert 22A that corresponds to the oval-shaped opening in the corresponding head (not shown); similarly, the third embodiment 20B comprises an octagonal-shaped insert 22B that corresponds to the octagonal-shaped opening in the corresponding head (also not shown). The outer edges of these embodiments, namely, 30A and 30B also form "shoulders" upon which their embodiments rest on top of the correspondingly-shaped heads. The respective apertures 32A and 32B correspond with the aperture 32 in the first embodiment 20, it being understood that the inserts 22A and 22B also comprise apertures on their opposite sides that correspond to aperture 34 in the first embodiment 20.

The present inventions 20-20B are provided as kits such that they can be easily applied to existing golf ball washers as discussed below. Each kit comprises an appropriate top (viz., top 22, top 22A or top 22B), the pump assembly 24, a container (e.g., a gallon, quart, etc.) of cleaning solution 100, and fasteners F (if not already present with the head 4). The following replacement procedure utilizes a kit using a circular top 22, it being understood that a similar procedure would be used for a kit for the oval-shaped top 22A or for the octagonal-shaped top 22B.

In particular, an authorized golf course attendant removes the top portion 2 and associated heavy brush assembly 3 of the golf ball washer 1. The contaminated water in the head 4 is drained (e.g., a drain, not shown, in the head 4 is opened, or, alternatively, the entire washer 1 is up-ended and the water is spilled out) in preparation for the delivery of the cleaning solution 100 therein, as shown in FIG. 2B. Once the cleaning solution 100 is poured into the head 4, the top 22 (or 22A or 22B, depending on the style of the head) is then installed over the top of the open head 4 by positioning the insert 28 into the upper portion of the head 4 and having the shoulder 30 rest on the upper surface of the head 4. The attendant makes certain to insert the top 22 such that the apertures 30 and 32 are aligned with the head apertures 8 and 9. A fastener F is then inserted through apertures 8 and 9 (or, alternatively, if those apertures 8/9 already comprise a captured fastener F) and the attendant then tightens this fastener F by hand, or using a tool (e.g., a hex key, pliers, etc.). If not already installed on the threads 36 through the opening 38, the intake tube 524 is fed in through the opening 38 and submerged in the cleaning solution 100 and the cover 424 is threaded onto the threads 36. If the spout 624 is not oriented over the cavity 26, the attendant rotates the spout 624 over the cavity 26.

When a user wishes to wash his/her dirty golf ball GB, the user places the ball GB in the nest 26 and depresses the pump head 124 to dispense the foaming soap 100A on the dirty ball GB in the nest 26. The cleaning solution 100 in the head 4 is an eco-friendly, sanitizing foaming soap solution. As mentioned previously, once the foaming soap 100A is dispensed over the dirty golf ball GB, the user dries the ball GB with the towel 5 and in doing so also moves the soap 30 around the ball GB and cleans it in the process in a more effective, eco-friendly manner, while sanitizing his/her own hands.

Similarly, the user may wish to clean other related golf equipment, e.g., the golf club head, the golf club grip, or any number of other related golf equipment. By way of example only, FIGS. 7A-7B depict a golfer using the present invention 20 to clean a dirty golf club face GCF. In particular, the user need only position the object to be cleaned underneath the spout 624, typically over the nest 26 and depress the pump head 124 to dispense a foaming soap solution 100A on the dirty golf club face GCF. The golfer then uses the towel 5 to disperse the foaming soap solution 100A over the dirty golf club face GCF and wipe it clean with the towel 5.

Figure 7:
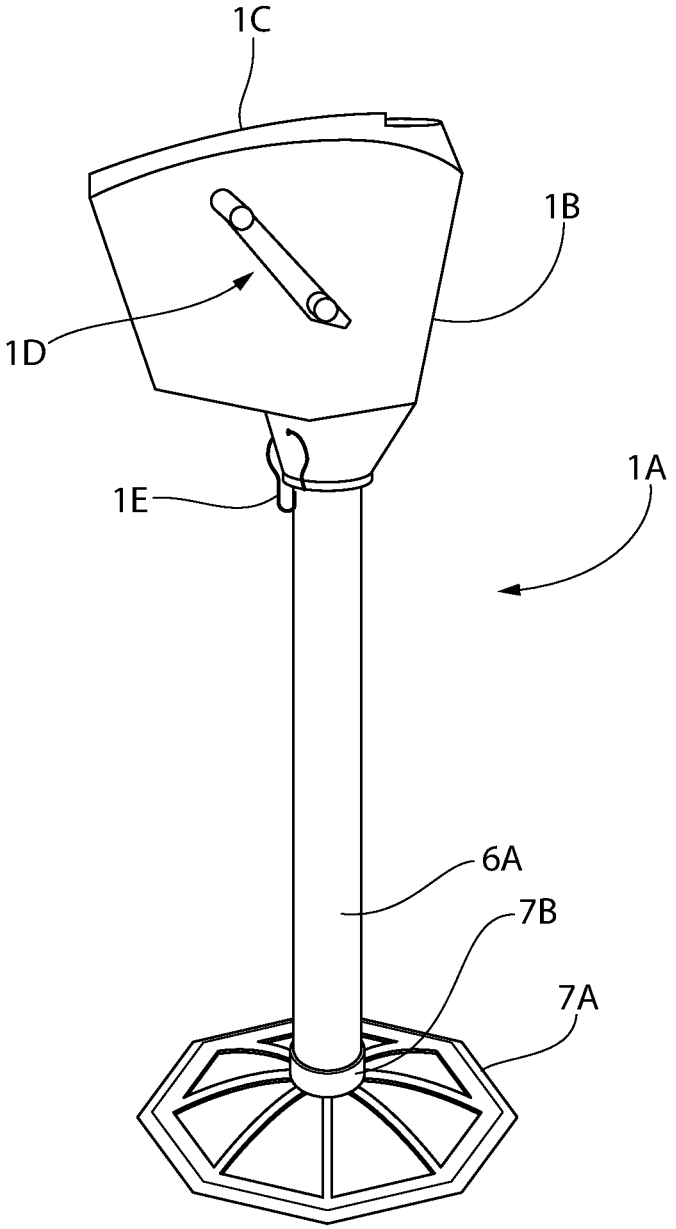
FIG. 7 (PRIOR ART)
FIG. 7 is a side view of another exemplary prior art conventional golf ball washer that uses a crank to wash the golf ball(s) placed inside.
Figure 8:
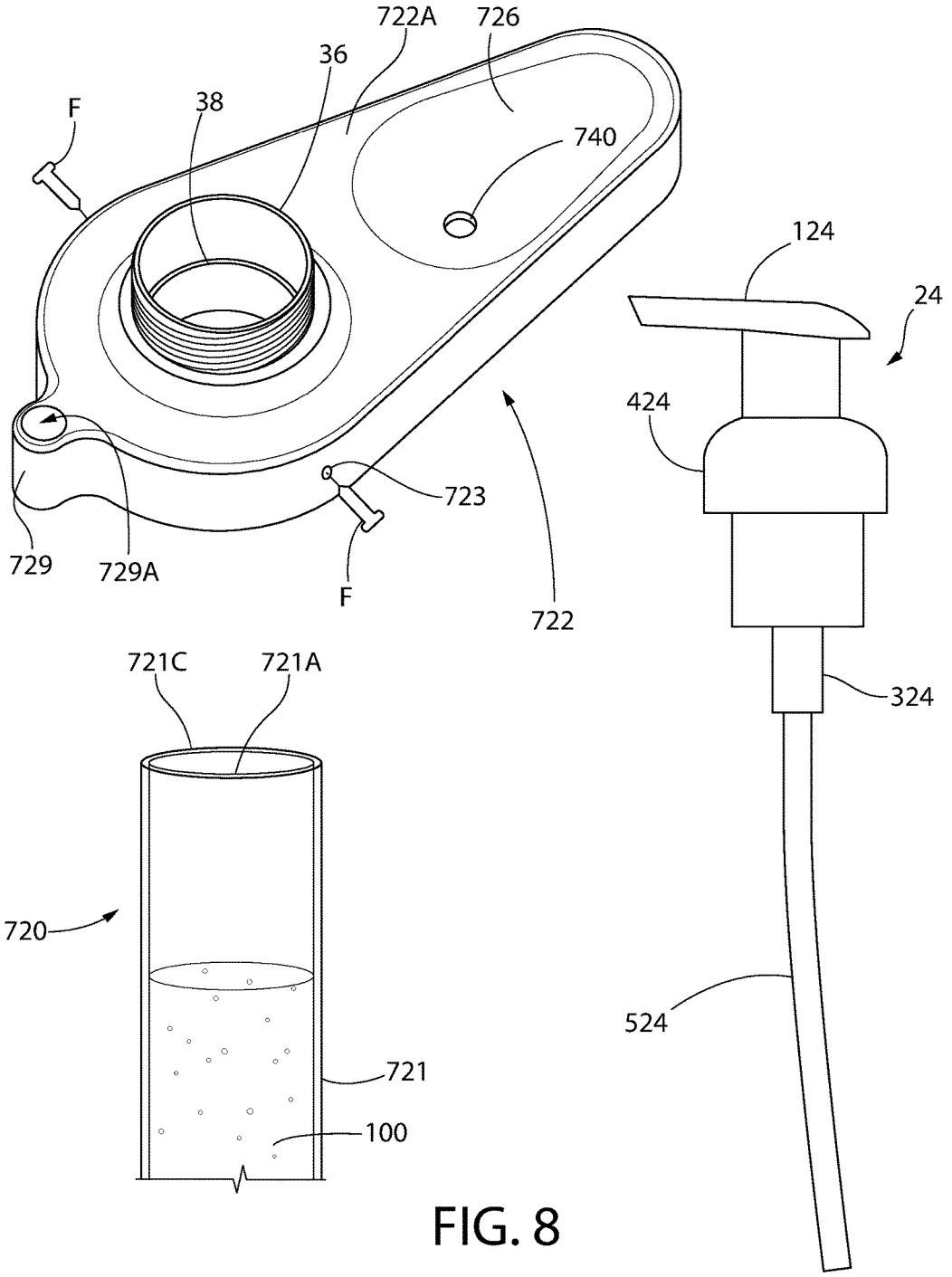
FIG. 8 is an exploded view of a fourth embodiment of the present invention wherein a hollow tube (shown as being transparent by way of example only) holds the cleaning solution and is closed off at the top with a head including a pump assembly and golf ball nest all of which replaces the washer of FIG. 7.
Figure 9:
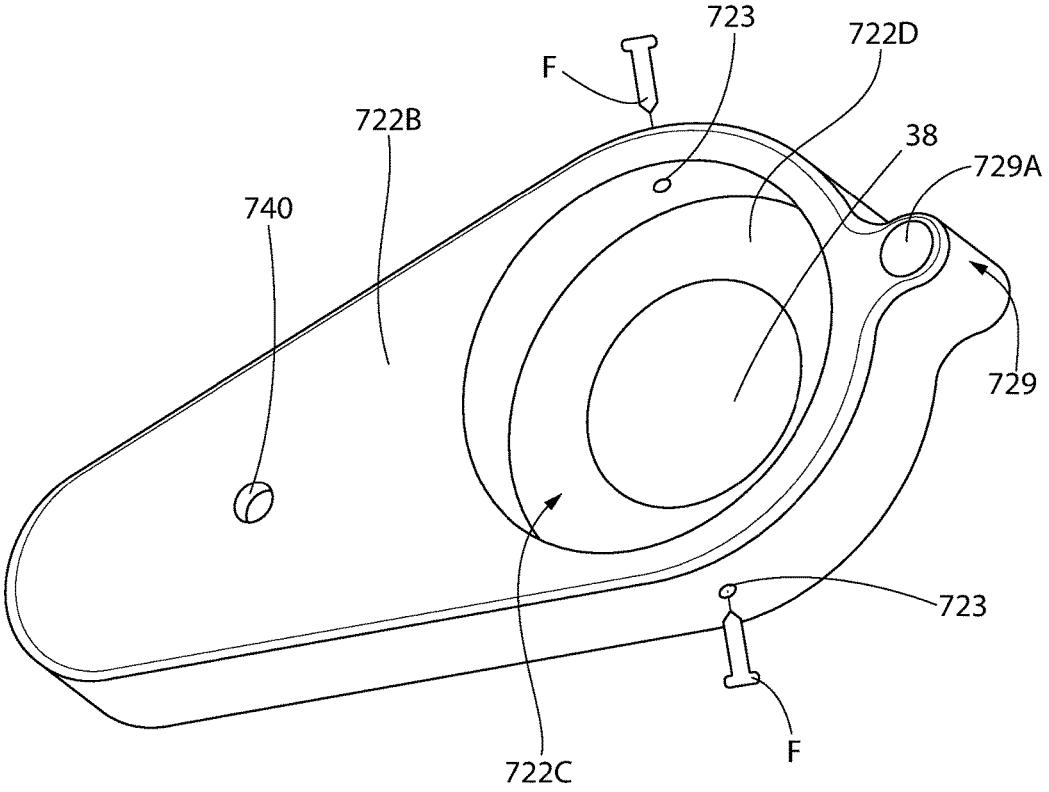
FIG. 9 is an isometric view of the bottom of the head of the fourth embodiment.
Figure 10:
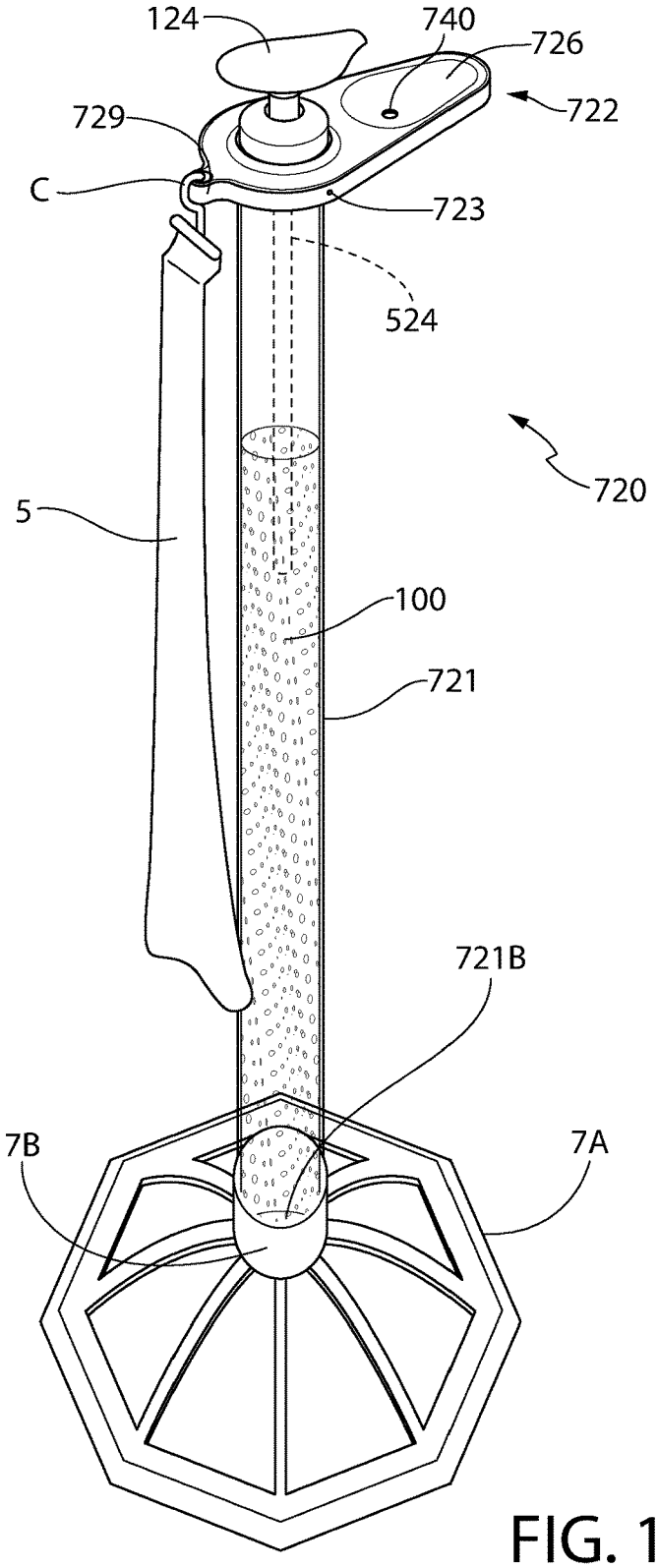
FIG. 10 is an isometric view of the assembled fourth embodiment (fasteners F, not shown) with the hollow tube shown as being transparent by way of example only.

To replace the conventional golf ball washer of FIG. 7, a fourth embodiment 720 of the present invention is provided as shown in FIGS. 8-10. In particular, the head 1B and shaft 6 are removed from the base 7A. An elongated hollow support tube 721 (e.g., aluminum, polyvinyl chloride (PVC), etc. It should be noted that FIGS. 8 and 10 depict the support tube 721 as being transparent but that is for clarity only) having an open top 721A and a closed bottom 721B is inserted into the base ring 7B, as shown in FIG. 8. The support tube 721 (e.g., 2⅜" outer diameter) is hollow to receive the foaming soap solution 100 therein. A head 722 (e.g., pair-shaped) is positioned on top of the open top 721A of the support tube 721 and then releasably-secured with fasteners F (as discussed above) via apertures 723 in the head 722. The head 722 and support tube 721 may comprise a variety of materials, e.g., aluminum.

The head 722 comprises a top side 722A (FIG. 8) that includes the pump opening 38 having corresponding threads 36 on its outer surface. The top side 722A also includes a golf ball nest 726 including a drain hole 740.

As shown most clearly in FIG. 9, when the opened end 721A of the support tube 721 is inserted into a cavity 722C in a bottom side 722B of the head 722, the extreme edge 721C of the tube 721 rests against shoulder surface 722D. As such, the open top 721A of the support tube 721 is aligned with the opening 38. The fasteners F can then be inserted through the apertures 723 to releasably secure the head 722 to the top end of the support tube 721.

It should be understood that the cavity 722C is by way of example only and there are many ways of coupling the head 722 with the elongated hollow support tube 721. For example, rather than using a cavity 722C, a collar (not shown) may project away from the bottom side 722B of the head 722 which is adapted to snugly receive the open end 721A therein; in that configuration, the apertures 723 would be present on opposite sides of the collar (rather than opposite sides of the head 722) and through which the fasteners F would be inserted and then tightened against the support tube 721. A passageway (also not shown) through the head 722 would be aligned with the threaded opening 38 and the open end 721A.

It should be further understood that it is within the broadest scope of the present invention to have the head 722 and the elongated hollow support tube 721 be unitized such that no assembly of the head 722 and support tube 721 is required (and, as such, fasteners F could also be omitted).

As such, the phrase "coupling the head 722 with the elongated hollow support tube 721" encompasses all of the above alternatives.

If the support tube 721 is not already filled with the foaming soap solution 100, the operator can pour the solution into the opening 38 to fill the support tube 721. Next, as shown in FIG. 8, the pump assembly 24 is then inserted through the opening 38 and then threadedly engaged with the opening's threads 36 as discussed previously.

A towel 5 is available at the head 722 using a coupler C (e.g., a hook, a snap hook lock, a spring snap, etc.) having the towel 5 attached thereto; as such, the coupler C releasably attaches the towel via an aperture 729A in a boss portion 729 along an outer edge of the head 722.

Figure 6D:
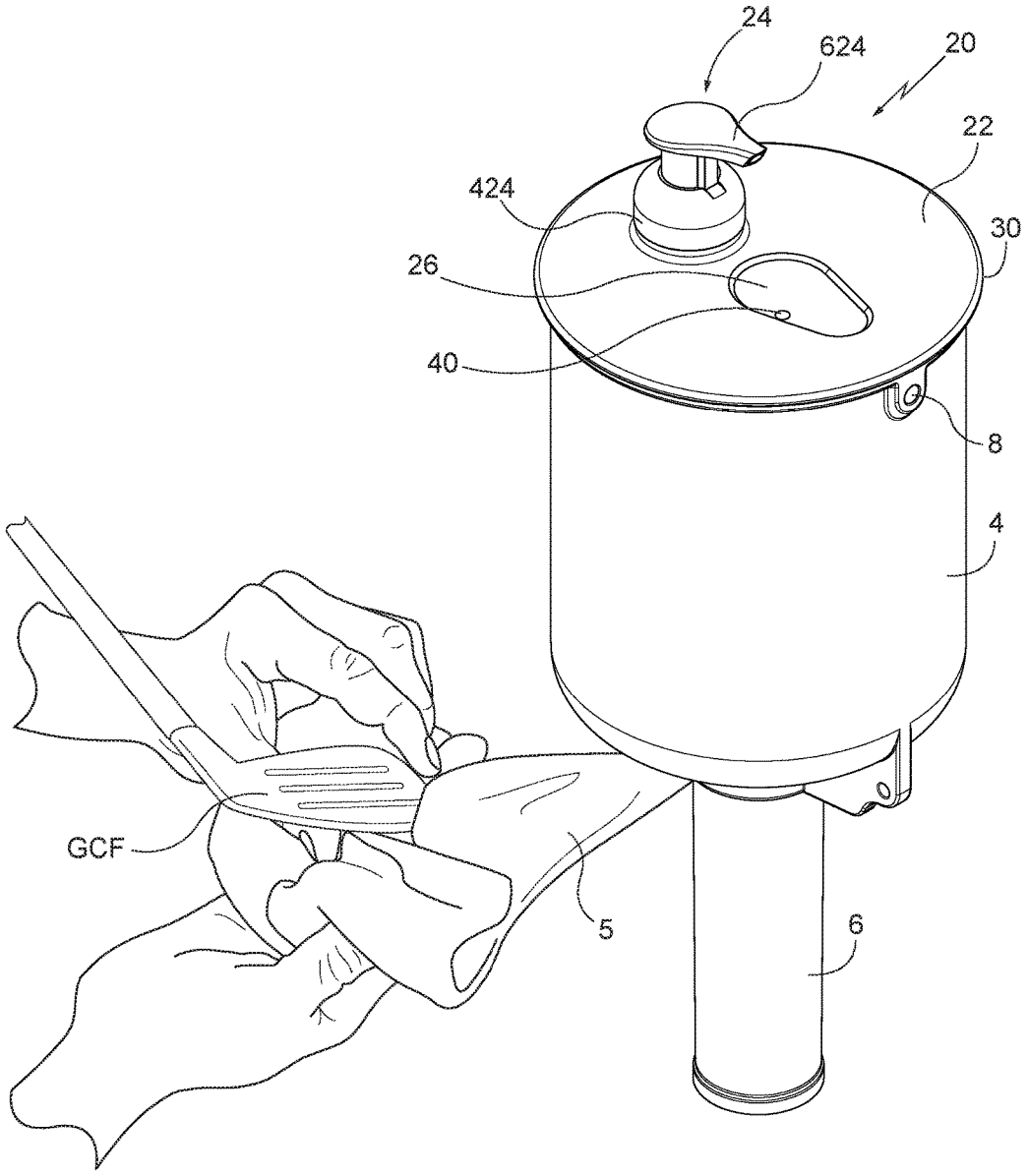

With the fourth embodiment washer 720 assembled, as shown in FIG. 10, a user can place a dirty golf ball in the nest 726 and wash the ball, as discussed previously with regard to FIGS. 6A-6B. Similarly, golf ball equipment (e.g., a golf club, etc.) can be cleaned using the washer 720, in a manner also previously discussed with regard to FIGS. 6C-6D.

The present invention 720 is also provided as a kit such that it can be easily applied to existing "crank" golf ball washers. Each kit comprises the head 722, the pump assembly 24, the hollow support tube 721, fasteners F and a container (e.g., a gallon, quart, etc.) of cleaning solution 100. As mentioned earlier, if the unitized head 772/support tube 721 is provided in the kit, the fasteners F are omitted.

In particular, an authorized golf course attendant removes the head 1A and associated shaft 6 of the golf ball washer 1A from the base ring 7B. The closed bottom of support tube 721 is inserted and secured into the base ring 7B such that the open end 721A is at the top of the support tube 721. Next, the attendant fits the head 722 onto the open end 721A of the tube 721 by inserting that end 721A into the cavity 722C on the bottom side 722B of the head 722 such that the edge 721C of the open end 721A is placed into contact with the shoulder surface 722D, forming a snug fit of the support tube 721 within the cavity 722C. The operator then releasably secures the head 722 to the support tube 721 by inserting the fasteners F and tightening them. The attendant then pours the cleaning solution 100 into the opening 38 to fill the support tube 721 with the cleaning solution 100. Once that is complete, the operator inserts the intake tube 524 of the pump assembly down through the opening 38 and into the cleaning solution in the support tube 721. The attendant then threadedly engages the collar 424 of the pump assembly 24 on the threads 36 of the opening. If the spout 624 is not oriented over the cavity 726, the attendant rotates the spout 624 over the cavity 726. The fourth embodiment 720 is ready for use. Operation of the fourth embodiment 720 is similar to that described previously with the previous three embodiments 20-20B.

It is within the broadest scope of the present invention 20-20B and 720 to include all types of cleaning solutions and associated pump assemblies for dispensing the cleaning solution. For example, rather than using a cleaning solution 100 that becomes a "foamed" soap solution upon dispensing, other cleaning fluids that remain in a liquid state when dispensed by their associated pump assemblies are certainly within the broadest aspect of the inventions 20-20B and 720.

Thus, the present invention 20-20B and 720 provides for an easy device for converting any conventional golf ball washer 1 and 1A into an "eco-friendly" ball washer. Because of its two part design (viz., the top 22/722 and the pump assembly 24) the present inventions 20-20B and 720 need no repair or maintenance and use sanitizing foaming soap (not contaminated water) dispensed in small amounts (via the limited dispense due to the activation of the pump handle 124 once). As a result, the present inventions 20-20B and 720 need refilling much less often, e.g., refills are required only once or twice over a typical multi-month golf season.

While the invention has been described in detail and with reference to specific examples thereof, it will be apparent to one skilled in the art that various changes and modifications can be made therein without departing from the spirit and scope thereof.

What is claimed is:

1. A device for converting a golf ball washer, having a lid with an internal cleaning assembly activated by a crank lever and all of which are supported on a shaft inserted into a base that rests on the ground, into a multi-golf item cleaning device, said device comprising:

an elongated-shaped head having a removable pump assembly having an intake line and a spout and further comprising a portion having a nest adapted for receiving a golf ball therein;

an elongated hollow support tube having a closed bottom and open top, said open top coupled to said head and wherein said intake line passes through said head and through said open top such that said portion of said head projects laterally beyond said elongated hollow support tube, and wherein said closed bottom is inserted within the base, said elongated support tube adapted to receive a cleaning solution therein; and wherein said pump assembly delivers a predetermined amount of the cleaning solution to the golf ball positioned under said spout when said pump assembly is activated.

2. The device of claim 1 wherein said head comprises a first side including a raised opening having threads, said raised opening adapted to engage corresponding threads on said pump assembly for releasably securing said pump assembly to said head.

3. The device of claim 2 wherein said head comprises a second side, opposite said first side, having a cavity therein, said cavity adapted for receiving said open top therein.

4. The device of claim 3 wherein said cavity comprises a shoulder that rests on top of an edge of said open top of said elongated hollow support tube.

5. The device of claim 4 wherein said cavity and said threaded opening are aligned.

6. The device of claim 3 wherein said head comprises a pair of apertures located on opposite sides of said head and each adapted to receive respective fasteners therein for releasably securing said head to said elongated hollow support tube.

7. The device of claim 2 wherein said first side comprises said nest and wherein said nest is aligned with said spout.

8. The device of claim 7 wherein said nest comprises a drain aperture at a lowest point in said nest, thereby preventing the accumulation of water or other liquids therein.

9. The device of claim 1 wherein said pump assembly converts said cleaning solution into a predetermined amount of foaming soap solution that is delivered to the item under the spout when said pump assembly is activated.

10. The device of claim 1 wherein said head comprises an aperture along an outer edge of said head, said aperture being adapted to receive a coupler that includes a towel for releasably securing the towel to said head.

11. The device of claim 1 wherein a golf club head is positioned under said spout when said pump assembly is activated.

12. A method for converting a golf ball washer, having a lid with an internal cleaning assembly activated by a crank lever and all of which are supported on a shaft inserted into a base that rests on the ground, into a multi-golf item cleaning device, said method comprising:

removing the conventional golf ball washer and shaft from the base;

inserting a closed end of an elongated hollow support tube into the base;

coupling an elongated-shaped head to an open end of said elongated hollow support tube, said head including an opening aligned with said open end and adapted for receiving a pump assembly therethrough, said head further comprising a portion having a nest adapted for receiving a golf ball therein and wherein said portion projects laterally beyond said elongated hollow support tube when said head is coupled to said elongated hollow support tube;

pouring a cleaning solution through said opening and into said elongated hollow support tube; and inserting said pump assembly having an intake line through said opening such that said intake line is positioned within said cleaning solution and a spout of said pump assembly is available for dispensing said cleaning solution.

13. The method of claim 12 wherein said step of securing said head onto an open end of said elongated hollow support tube comprises inserting said open end into a cavity within said head and wherein said opening and said cavity are aligned.

14. The method of claim 13 wherein said step of securing the head onto the open end comprises engaging fasteners through respective apertures, on opposite sides of said head, to contact said support tube positioned in said cavity.

15. The method of claim 12 further comprising the steps of:

positioning a golf item under said spout; and activating said pump assembly to dispense a predetermined amount of the cleaning solution to the golf item positioned under said spout.

16. The method claim 12 wherein said step of coupling the head onto the open end comprises aligning said nest with said spout for receiving a dirty golf ball within said nest.

17. The method of claim 16 wherein step of coupling a head onto the open end comprises forming an aperture at a lowest point within said nest to prevent the accumulation of water or other liquids therein.

18. The method of claim 12 further comprising the steps of: placing a golf ball in said nest under said spout; and activating said pump to dispense a predetermined amount of cleaning solution on the golf ball.

19. The method of claim 12 further comprising the steps of: placing a golf club head under said spout; and activating said pump to dispense a predetermined amount of cleaning solution on the golf club head.

* * * * *